US005873757A

United States Patent [19]

Van Balen

[11] Patent Number: 5,873,757

[45] Date of Patent: Feb. 23, 1999

[54] ADJUSTABLE OARLOCK PIN AND RIGGING ASSEMBLY

[76] Inventor: Gary L. Van Balen, 2536 Country Side La., Wexford, Pa. 15090-7940

[21] Appl. No.: 915,900

[22] Filed: Aug. 21, 1997

[51] Int. Cl.[6] ..... B63H 16/06

[52] U.S. Cl. ..... 440/105; 440/106

[58] Field of Search ..... 440/101, 104, 440/105, 106, 107, 108, 109

[56] References Cited

U.S. PATENT DOCUMENTS

| | | | |
|---|---|---|---|
| 468,960 | 2/1892 | Vondersaar | 440/109 |
| 700,827 | 5/1902 | Rollins | 440/105 |
| 1,213,233 | 1/1917 | Morton | 440/106 |
| 2,550,625 | 4/1951 | Vick | 440/107 |
| 3,898,950 | 8/1975 | Martin | 115/241 |
| 4,352,667 | 10/1982 | Neville | 440/105 |
| 4,411,214 | 10/1983 | Horiuchi | 114/347 |
| 4,516,941 | 5/1985 | Reid | 440/105 |
| 4,889,509 | 12/1989 | Pohlus | 440/105 |
| 5,324,218 | 6/1994 | Rijnders | 440/107 |
| 5,474,008 | 12/1995 | Vespoli et al. | 114/56 |

*Primary Examiner*—Stephen Avila

*Attorney, Agent, or Firm*—Arnold B. Silverman; Eckert Seamans Cherin & Mellott, LLC

[57] ABSTRACT

An oarlock for a rowing shell has an elongated housing with a screw member secured therewithin for rotational movement, but not axial movement therewithin. At least one guide member is secured within an elongated slot member and is threadedly secured to the screw member, such that rotation of the screw will cause responsive movement of the guide member or members within the slot or slots. By rotatably securing the oarlock either below a sole guide member or between the guide members around the exterior of the housing, rotation of the screw will effect translational movement of the oarlock pin to facilitate desired adjustment thereof. A manually rotatable adjustment element permits rotation of the screw while the rowing shell is in the water to thereby permit adjustment to the rowing conditions, such as the weight and size of the rower and water conditions. A rigging has struts securing the rigger to the rowing shell and the oarlock rotatably secured to the oarlock pin of the present invention.

23 Claims, 4 Drawing Sheets

ADJUSTABLE OARLOCK PIN AND RIGGING ASSEMBLY

BACKGROUND OF THE INVENTION

1. Field of the Invention

This invention relates to rowing shell rigging, and to a manually adjustable oarlock pin which supports the oarlock and provides a manual adjustment means for oarlock height adjustment for proper fit of the oar to the rower and rowing conditions.

2. Description of Prior Art

Rowing shells, consisting primarily of rowing boats and sculling boats, are moved through the water by oars. The oars transmit the power of the rower, drawing on strength and proper motions primarily from legs, arms, and back. The speed of the shell is determined by strength, technique, and the efficiency of the transmission of the rower's power through the oar to the water.

Among other things, the transmission of the rower's power is dependent on the relationship of the oar to the rower's body and the surface of the water. This relationship or geometry is determined by, among other things, the inboard and outboard lengths of the oar, stern and lateral pitch, and the height of the oarlock relative to the water. It is generally considered most efficient if, at the finish of the stroke, with the boat "set," the butt of the oar handle comes to a point an inch or two above the xiphoid process, which is the bottom of the rower's sternum. For that to happen, the fulcrum for the oar, the oarlock, must be at the correct height for the individual rower in his or her seat, for the particular boat. Additionally, the vertical angle of the oarlock, which controls the pitch of the blade of the oar is important and dependent on the rower's skill, wind and water conditions.

Various means have been suggested for improving the adjustability or efficiency of the operation of boats that are powered by rowers. See, generally, U.S. Pat. Nos. 4,889,509; 5,324,218; 5,474,008; 4,516,941; and 3,898,950. These patents do not, however, disclose the use of oarlock pins which may be readily adjusted in the water so as to accommodate the variations in the rower's size, weight, crew size, rower's position in the boat and other factors, such as water conditions.

In racing shells, the oarlock, which supports the oar, pivots on an oarlock pin which is supported by a rigger attached to the gunwale of the shell. The rigger and oarlock are designed to allow the oar to move as follows during each stroke: (a) to rotate about the longitudinal axis of the oarlock pin (allowing the oar to sweep through an arc which lies in an essentially horizontal plane); (b) to rotate about an axis which is perpendicular to the longitudinal axis of the oarlock pin (allowing the oar to sweep through an arc which lies in an essentially vertical plane); and (c) to rotate about the oar's own longitudinal axis (allowing the blade of the oar to be "feathered" or "squared" as necessary throughout the stroke).

Generally, the rigging which includes the rigger, oarlock pin, and oar, is adjustable to accommodate the difference in size and weight of rowers, different rowing techniques and different rowing conditions. In particular, the rigger and oarlock pin are designed to allow the oarlock to be adjusted in height above the water and distance from the centerline of the shell. The vertical angle of the pin is frequently also adjustable to facilitate adjusting the angle of the oarlock, which affects the "pitch" of the blade of the oar relative to the surface of the water.

The design and construction of most rigging is such that adjusting one aspect of the geometry of the rigging, like the height of the oarlock, requires a relatively complex sequence of adjustments to one or more of the rigger's structural elements. Sometimes, portions of the rigging must be partially or fully disassembled then reassembled to make an adjustment to the height of the oarlock. These adjustments usually require simple hand tools. Frequently, adjusting the height of the oarlock is a trial and error process until the right height is found for each individual rower, boat, crew weight and water condition. As a result of the difficulty in making such adjustments, they are normally made on land prior to placing the rowing shell in the water, or they are not made at all because it is not practical to make such adjustments each time a rower switches boats or seats in a boat. If the oarlock height is not properly adjusted for each individual rower, the efficiency of the crew and maximum sustainable speed of the rowing shell are reduced.

A primary concern for rowers of shells is adjusting the height of the oarlock so the hand on the inboard section of the oar moves through the proper plane while the blade of the oar moves through the water at the proper depth during the drive. Currently, adjusting the oarlock height on most shells is relatively complex and may require the use of tools, such as wrenches. See, generally, U.S. Pat. Nos. 4,352,667 and 4,411,214. One either adds or removes spacers, and loosen nuts and bolts and moves the oarlock pin, which supports the oarlock and permits it to rotate as needed, up or down through threads in the rigger assembly.

Prior art oarlock pins typically have one or more of the following disadvantages.

In prior art practices, it is necessary to adjust the oarlock height before the shell is placed on the water. This is because the position of the rower in the shell relative to the oarlock and oarlock pin, and the relative instability of rowing shells, makes it very difficult and often impossible for the rower to make any oarlock adjustments, except under emergency conditions. Usually, if oarlock height adjustments are necessary after the shell is placed on the water, a coaching launch is positioned next to the shell and the adjustments are made by an individual from the launch. This is very difficult and inconvenient for the shell crew and the coach. In addition, there is a risk that the rowing shell will be damaged by the launch as the two boats pitch and roll in the water in response to wind and waves. This can be a very difficult and time-consuming activity.

Currently oarlock height adjustments requite using hand tools such as pliers, wrenches, screwdrivers or hex wrenches. Some types of shell rigging require partial disassembly and reassembly to make oarlock height adjustments.

Some current methods of oarlock height adjustment adversely affect other aspects of rigger geometry such as blade pitch. This usually requires readjustment of other aspects of rigger geometry after the height has been modified.

As the rower is not normally in the shell and the shell is not normally on the water when oarlock height is adjusted, measurements are often made between the oarlock and some reference point such as the rower's seat to help estimate the adequacy of adjustments. This is at best inaccurate because it does not consider such factors as the depth at which the shell rides in the water due to crew weight, for example.

A change in crew weight by switching crew positions or substituting rowers results in a change in the shell trim or how deep the shell rides in the water. This affects hand levels and may require oarlock height adjustments. The need for or magnitude of oarlock height adjustments will depend on the magnitude of the change in crew weight.

Some shells are rowed by a crew, each of a different physical size making it necessary to adjust the height of each oarlock to suit the needs of each individual rower. Oarlock height adjustments are difficult enough that they are often not made. Instead, the rower is forced to adjust his rowing technique to accommodate the improper oarlock height. This forces the rower to assume a less than optimal posture in the shell.

There remains, therefore, a very real and substantial need for an effective means for manually adjusting oarlock pin height while a boat is in the water in order to provide for efficient use of the power generated by the rower.

SUMMARY OF THE INVENTION

The present invention has met the above-described needs by providing a manually adjustable oarlock pin and a related rigging which permits ready adjustment of the oarlock pin height while the rowing shell is in the water.

In one embodiment of the invention, an oarlock pin for a rowing shell has a housing within which is a screw member which is rotatable, but cannot be moved in a translational direction. At least one guide member is adapted to be subjected to reciprocating movement within a slot. A pair of slots may be employed and may be positioned in general alignment with each other and generally parallel to the screw axis. Adjustment means which are fixedly secured to the screw at a position exteriorly of the housing are adapted to be rotated in a first direction to effect movement of the two guides in a first direction and rotated in the opposite direction to achieve movement of the guides in the other direction. The oarlock has a tubular bore which is received over the housing portion disposed between the two guides for relative free rotational movement with the housing. Responsive to axial rotation of the screws due to rotation of the adjustment means the guide members move and as a result raise or lower the oarlock responsively. In a preferred embodiment an upper bolt has external threads which are in threaded engagement with threads on the interior upper end of the housing and also has a bore which permits relative free rotational movement between the screw and the bolt. In this embodiment, the adjustment means is fixedly secured to the screw and an overlying lock nut secures the assembly.

The rigging may secure the oarlock pin to the gunwale or other portions of the boat by suitable struts.

It is an object of the present invention to provide a manually adjustable oarlock pin which permits the height of the oarlock to be changed by a rower of a rower's shell to suit his or her individual needs while the shell is in the water while not affecting the pitch of the oar.

It is another object of the present invention to facilitate such adjustment in height of the oarlock without affecting the geometry of the rest of the rigging which supports the oarlock.

It is a further object of the present invention to provide such an oarlock and associated rigger which is adapted for use with conventional rigging without requiring meaningful modification of the rigging.

It is another object of the present invention to provide a mechanically adjustable oarlock pin which makes it possible for rowers to adjust the height of the oarlock without requiring the use of tools, and without changing the blade pitch or other aspects of the supporting rigging.

It is another object of the present invention to provide an adjustable oarlock pin wherein adjustment can be easily accomplished while rowers are sitting in their seats in the normal rowing position with the rowing shell on the water floating at the depth and trim under which the rowers will row.

It is another object of the invention to provide such a system wherein, if height adjustment must be made on the water, there is no need for the coaching launch to approach the shell to assist with oarlock height adjustments increasing the safety for both boats.

It is another object of the invention to provide an adjustable oarlock pin which is self-contained with no loose pieces which might be dropped overboard or lost while making height adjustments.

It is a further object of the present invention to facilitate rapid and simplified manual adjustment of oarlock height.

It is yet another object of the invention to provide a manually adjustable oarlock which after the crew has been instructed in the proper use of the adjustable oarlock pin, little or no additional instruction or oversight will be needed prior to subsequent oarlock height adjustments.

It is yet another object of the present invention to provide a manually adjustable oarlock and associated rigger which has the ability to make quick oarlock height adjustments which will allow a single rowing shell to be rowed by many different crews.

These and other objects of the invention will be more fully understood from the following description on reference to the illustrations appended hereto.

DESCRIPTION OF THE PREFERRED EMBODIMENTS

As employed herein, the term "rowing shells" means sweep boats, sculls, canoes and other rowing boats, for which it would be convenient to adjust the height of the oarlock regardless of what means are employed to attach it to the boat.

As employed herein, the term "rigging" means the rigger and oarlock pin of a rowing shell.

Figure 1:
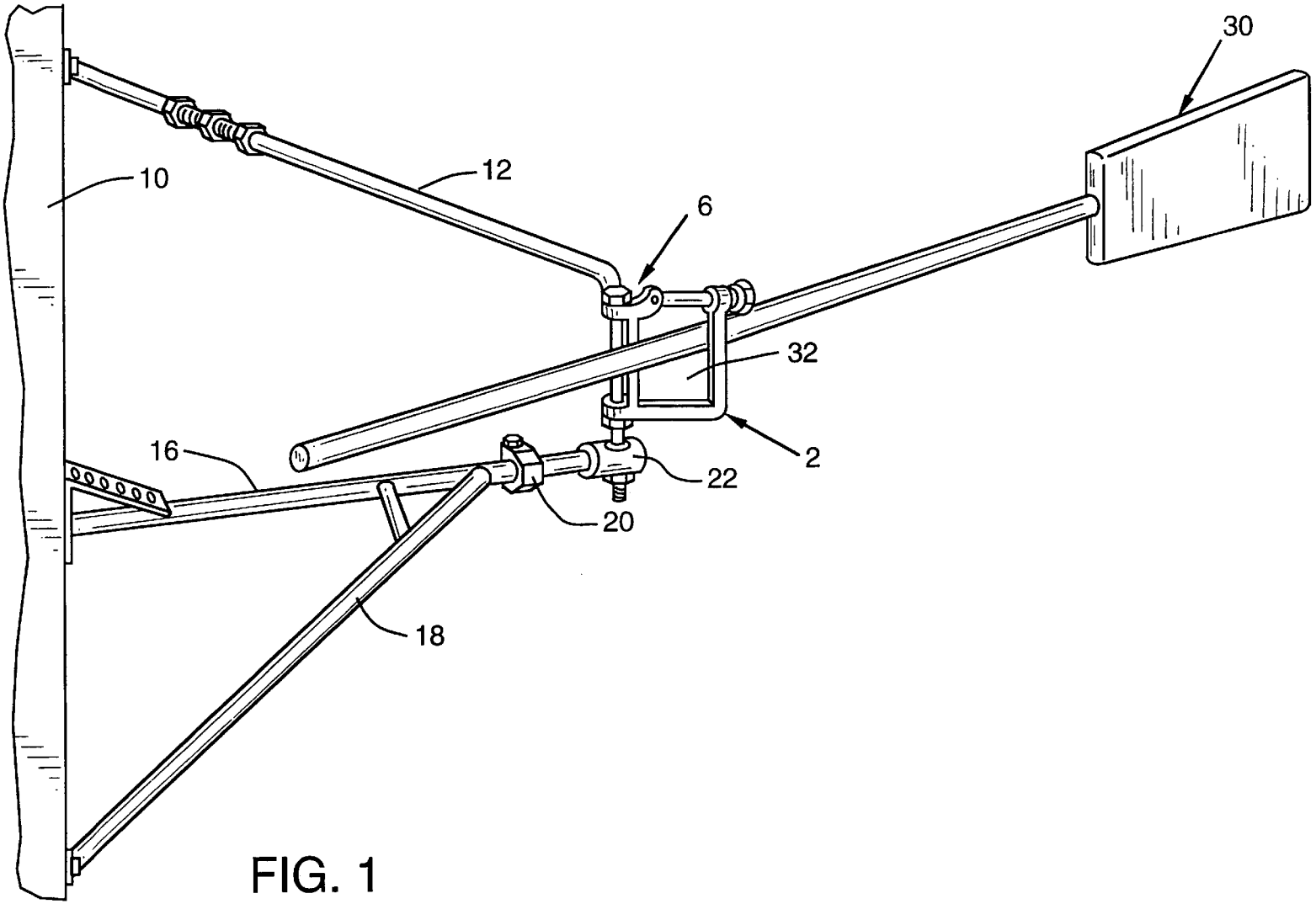
FIG. 1 is a partially schematic perspective view of a form of rigging incorporating an adjustable oarlock pin of the present invention.

Referring more specifically to FIG. 1, in the form shown an oarlock 2 which is rotatably secured to an oarlock pin 6 of the present invention and is fixedly secured to the gunwale 10 of a rowing shell by suitable struts, such as top strut 12, which is secured to the oarlock pin 6 and main strut 16 and front strut 18 which are joined at clamp member 20 and are secured by strut extension 22 to a lower portion of the pin. An oar 30 is received through the opening 32 in the oarlock. It will be appreciated that numerous other means for securing the oarlock to the rowing shell will be known to those skilled in the art may be employed.

Figure 2:
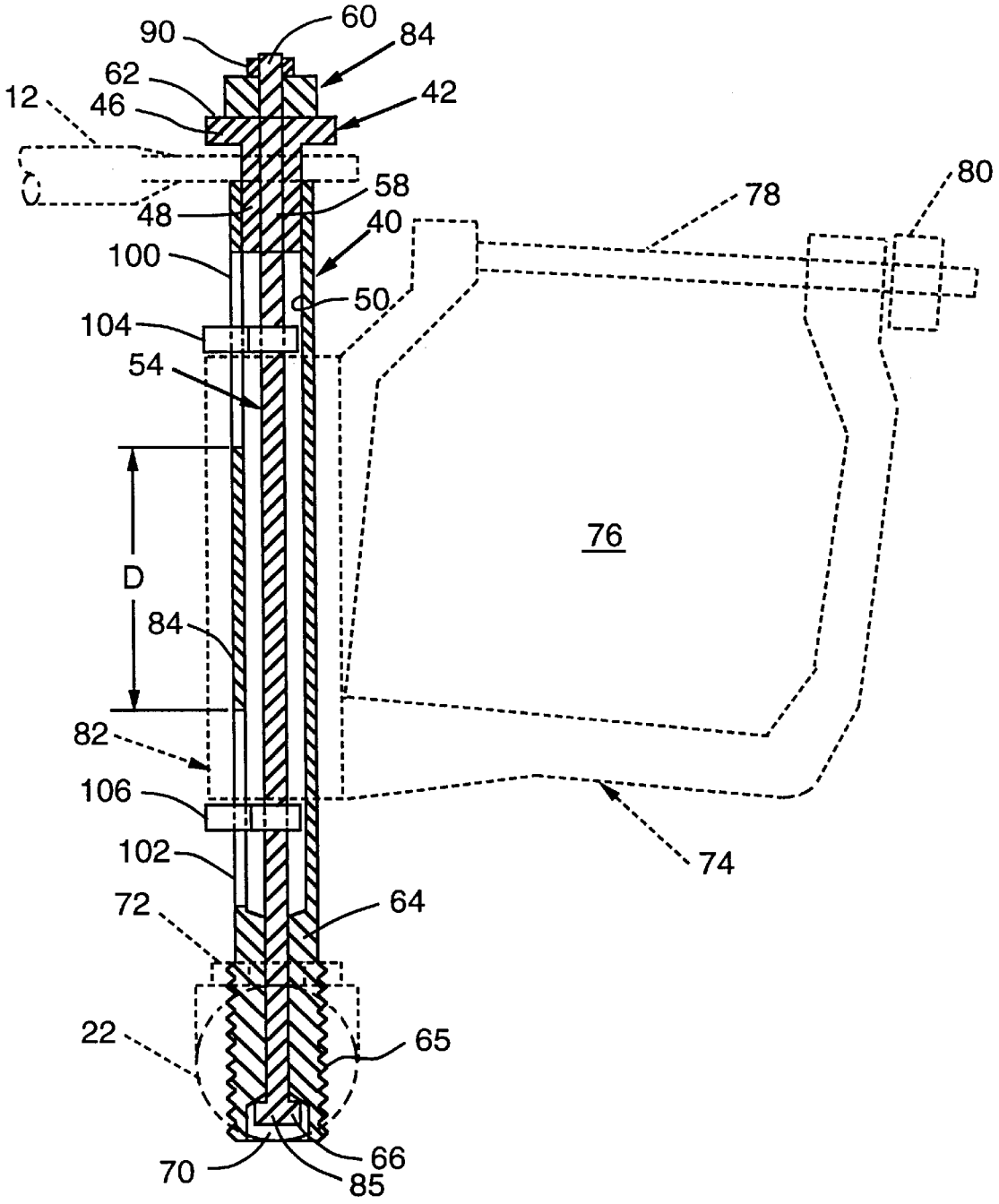
FIG. 2 is a cross-sectional illustration showing a preferred embodiment of the adjustable oarlock pin of the present invention with the oarlock and other portions of the associated apparatus being shown in broken lines.
Figure 3:
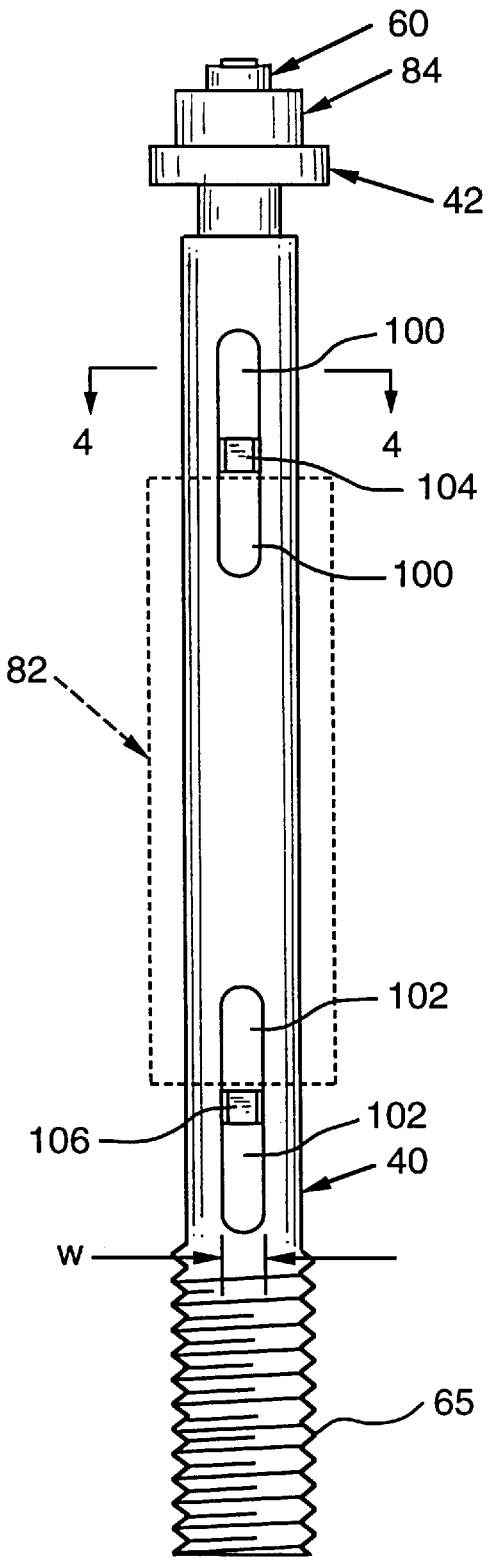
FIG. 3 is an elevational view of the oarlock pin of the present invention.
Figure 4:
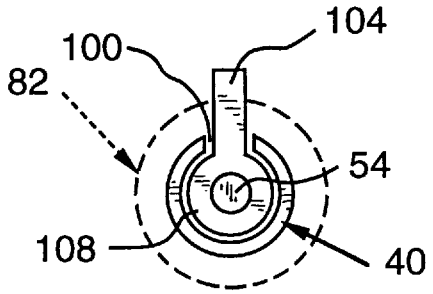
FIG. 4 is a cross-sectional illustration taken through 4—4 of FIG. 3.

Referring to FIGS. 2 through 4, the oarlock pin has a housing 40 which is generally tubular and may be made of any suitable material, such as steel, aluminum or stainless steel with or without an exterior finish coating. A screw 42 has a head portion 46 which generally would be secured in intimate contact with strut 12, but is shown spaced for clarity of illustration and a hollow shank portion 48 which is externally threaded and is secured to the upper portion of the inner surface 50 of the housing 40. An axially rotatable screw 54 is disposed within the housing 40 and passes through the unthreaded internal bore 58 of bolt 42 thereby permitting free relative rotation therebetween. The screw 54 has an extended portion 60 which projects beyond the upper surface 62 of bolt 42. The lower end of the bolt 54 is received within a restricted passageway defined by annular wall 64 of housing 40 and terminates in an enlarged head 66. Free rotation between the screw 54 and the wall 64 is permitted, but the opening defined by annular wall 64 is sufficiently small that substantial translational movement of the screw 54 in an axial direction is resisted. Also shown in FIG. 2 is the head 66 being received within a recess 70 of the housing 40. The upper strut 12 is secured to the oarlock pin by having bolt 42 pass through an opening (not shown) therein. Similarly, the connecting strut 22 is secured to the lower end of the oarlock pin by nut 72. The exterior of the lower portion of housing 40 has threads 65 and is threadedly engaged with strut element 22. Strut element 22 is, in the form shown, retained in place by lock nut 72 which is threadedly connected to the exterior of housing 40.

The oarlock 74 defines an oar receiving opening 76 which has its upper extremity closed by a pin or screw 78 which is secured in place by locking member 80 which may be a nut. The oarlock 74, in the form shown, also has a generally tubular portion 82 which is received over the exterior surface 84 of the housing 40 so as to permit free relative rotation therebetween.

At the uppermost portion of the screw 54 in the extension area 60, an adjustment knob 84 which is manually engageable is fixedly secured to screw extension 60. In this embodiment the fixed securement of the adjustment knob 84 to the screw extension 60 is effected by the nut 90. It will be appreciated that manual rotation of the adjustment knob 84 will produce responsive axial rotation of the screw 54.

A screwdriver slot 85 is preferably provided in head 66 to facilitate disassembly of the oarlock pin by removal of lock nut 90, adjustment knob 84 and bolt 42, thereby permitting axial withdrawal of screw 54 from housing 40.

As shown in FIGS. 2 through 4, threaded onto adjusting screw 54 and projecting through elongated first and second slots 100 and 102 in the side of housing 40 are two moveable guides 104, 106. The arrangement of moveable guides 104, 106 and slots 100, 102 resist meaningful rotation of moveable guides 104, 106 with adjusting screw 54 as it rotates axially. As the moveable guides 104, 106 are threaded onto the adjusting screw 54, the moveable guides 104, 106 translate along adjusting screw 54 in response to the screw 54 being turned by adjusting knob 84. While in the preferred embodiment a pair of guides 104, 106 are employed, a single guide may be employed if desired. For example, guide 106 which underlies and supports tubular portion 82 may be employed. Also, where more than one guide is employed, they need not be aligned with each other but may be circumferentially displaced with respect to each other while being at different elevations.

The elongated slots 100, 102, in the form shown, have their ends spaced from each other a distance D (FIG. 2) which is preferably about 1 to 3 inches. The slots 100, 102 are preferably elongated and have a width W which is greater than the width of the portions of the guide means 104, 106 which project exteriorly through slots 100, 102. The guide means 104, 106 are received, respectively, in slots 100, 102 for relative sliding movement. The slots 100, 102 are oriented generally in the same direction as the axis of screw 54 and are generally parallel to the axis. Moveable guides 104, 106 move together maintaining the distance between them which is set during assembly of the adjustable oarlock pin.

In practice, each rower in a shell would set his or her individual oarlock height as follows. The shell would be brought to a stop on the water with rowers sitting at the "finish" of the stroke, blades "squared" and floating at the proper depth in the water. While maintaining proper "set of the shell," each rower would turn the adjusting knob 84 at the top of his or her adjustable oarlock pin until the handle of his oar was at the proper "hand level" for his body.

It will be appreciated that with the present invention a significant improvement in rowing will result from the adjustable oarlock pin of this invention. It permits each rower to adjust the height of his or her own oarlock on the water while the shell is fully loaded and each rower is in "rowing position." In addition, the adjustable oarlock pin of this invention permits the adjustment of the height of the oarlock in the water, simply, quickly, and without tools, measurements or skill.

It will be appreciated that with the oarlock 74 having bore portion 82 freely rotatable about the housing 40 between guide members 104, 106 that movement of the guide members responsive to rotation of screw 54 causes upward or downward responsive movement of the oarlock 74. All of this is effected in an efficient manner on land or in water by rotation of adjustment knob 84. FIG. 4 shows the upper guide member 104 having an internally threaded bore defined by annular portion 108.

Figure 5:
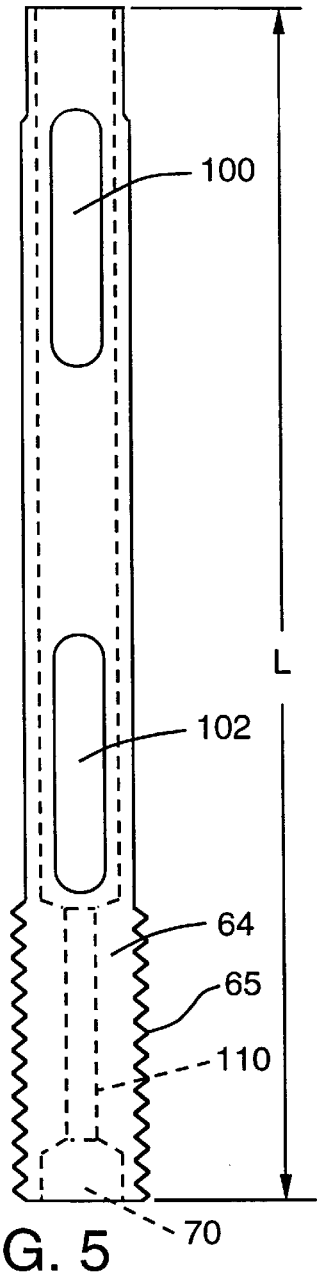
FIG. 5 is an elevational view of the housing of a preferred embodiment of the oarlock pin of the present invention.
Figure 6:
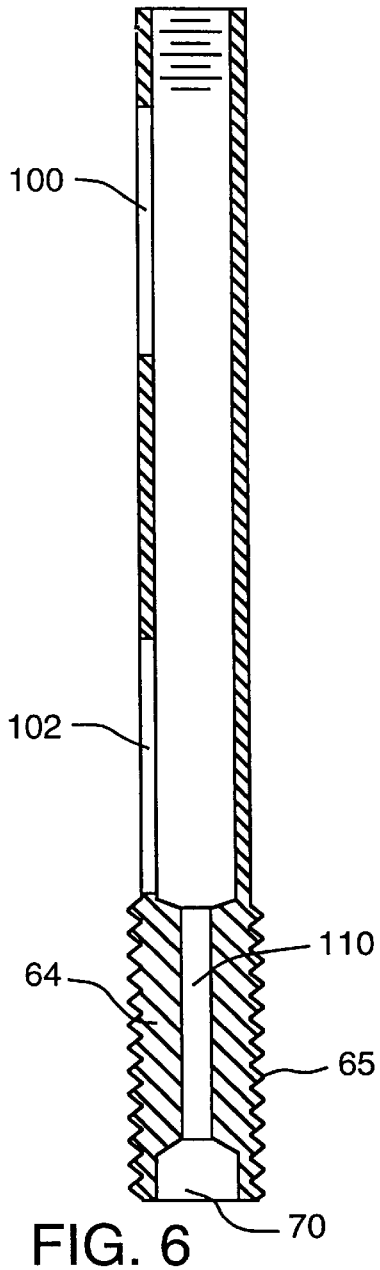
FIG. 6 is a cross-sectional illustration of the housing of FIG. 5.

With reference to FIGS. 5 and 6, details of the housing are shown. FIG. 5 shows the slots 100, 102, the inner wall 64 which defines the restricted passageway 110 through which the lower end of screw 54 passes. The slots 100, 102 may each have an axial extent which is about 1 to 2 inches.

Figure 7:
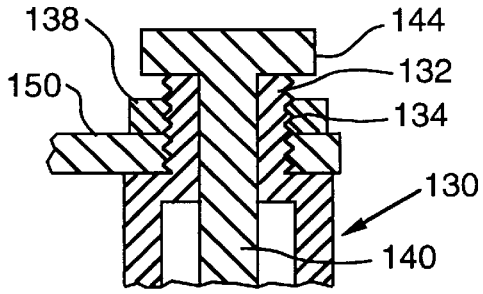
FIG. 7 is a fragmentary cross-sectional illustration of another embodiment of the housing.

In the modified embodiment of the housing 130, shown in FIG. 7, an externally threaded stud portion 132 is of reduced diameter with respect to other portions of the housing 130 and is formed as an integral extension thereof 132 having integrally formed external threads 134. The strut 150 is secured thereto by means of a lock nut 138. The projecting portion of the screw 140 is threadedly secured to knob 144.

Whereas particular embodiments of the present invention have been described herein for purposes of illustration, it will be appreciated by those skilled in the art that numerous variations of the details may be made without departing from the invention as described in the appended claims.

I claim:

1. An oarlock pin for a rowing shell comprising a generally tubular housing, an elongated screw secured within said housing for rotatable movement therewithin, said oarlock pin having at least one generally axially oriented slot in said housing, a guide member threadedly secured to said screw and projecting radially outwardly from a said slot, rotatable adjustment means for effecting rotation of said screw and being disposed exteriorly of said housing, and said housing structured to be in rotatable engagement with an oarlock which is disposed therearound overlying one said guide member, whereby axial rotation of said screw will effect responsive movement of said guide member within a said slot thereby effecting responsive movement of said oarlock.

2. The oarlock pin of claim 1 including employing first and second said slots and first and second said guide members, and said oarlock rotatably engaging said housing between said first and second guide members.

3. The oarlock pin of claim 2 including said first slot and said second slot each being generally aligned and spaced from each other and being oriented generally parallel to the axis of said screw.

4. The oarlock pin of claim 3 including said first guide member being disposed within said first slot at a position generally identical to the position of said second guide member within said second slot.

5. The oarlock pin of claim 3 including said first and second guide members each having projecting portions of smaller width than said respective slots disposed exterior of said housing, whereby said guide members will move efficiently within said slots.

6. The oarlock pin of claim 5 including said first slot being spaced from said second slot about 1 to 3 inches.

7. The oarlock pin of claim 2 including said housing having a portion between said first and second guides which is structured to receive an elongated bore of said oarlock while permitting relative rotation between said housing and said oarlock.

8. The oarlock pin of claim 7 including an upper bolt extending axially into the upper end of said housing and having external threads in threaded engagement with the upper bore of said housing and having an elongated bore through which said screw passes.

9. The oarlock pin of claim 8 including said adjustment means being fixedly secured to said screw, whereby rotation of said adjustment means will effect axial rotation of said screw in one of two directions responsive to the direction of rotation of said adjustment means.

10. The oarlock pin of claim 9 including said screw having an elongated head at the lower end, and said housing having a restricted recess within said lower end wherein said enlarged head is received.

11. The oarlock pin of claim 10 including said lower end of said housing having a restricted passageway through which said screw will pass, but said head will not pass.

12. The oarlock pin of claim 7 including said housing having an externally threaded integrally formed upwardly projecting stud, and said screw extending therethrough.

13. Rigging for a rowing shell comprising a rigger having a plurality of struts secured to an oarlock pin, a generally tubular housing, an elongated screw secured within said housing for rotatable movement therewithin, said oarlock pin having at least one generally axially oriented slot in said housing, a guide member threadedly secured to said screw and projecting radially outwardly from said at least one said slot, rotatable adjustment means for effecting rotation of said screw and being disposed exteriorly of said housing, and said housing structured to be in rotatable engagement with an oarlock which is disposed adjacent to said guide member, whereby axial rotation of said screw will effect responsive movement of said guide member within said slot thereby effecting movement of said oarlock.

14. The rigging of claim 13 including a second guide member threadedly secured to said screw and projecting radially outwardly through a said second slot.

15. The rigging of claim 13 including said first slot and said second slot each being generally aligned and spaced from each other and being oriented generally to the axis of said screw.

16. The rigging of claim 15 including said first guide member being disposed within said first slot at a position generally identical to the position of said second guide member within said second slot.

17. The rigging of claim 15 including said housing having an externally threaded integrally formed upwardly projecting stud, and said screw extending therethrough.

18. The rigging of claim 17 including said first slot being spaced from said second slot about 1 to 3 inches.

19. The rigging of claim 13 including said housing having a portion between said first and second guides which is structured to receive an elongated bore of said oarlock while permitting relative rotation between said housing and said oarlock.

20. The rigging of claim 19 including an upper bolt extending axially into the upper end of said housing having external threads in threaded engagement with the upper bore of said housing and having an elongated bore through which said screw passes.

21. The rigging of claim 20 including said adjustment means being fixedly secured to said screw, whereby rotation of said adjustment means will effect axial rotation of said screw in one of two directions responsive to the direction of rotation of said adjustment means.

22. The rigging of claim 21 including said screw having an elongated head at the lower end, and said housing having a restricted recess within said lower end wherein said enlarged head is received.

23. The rigging of claim 22 including said lower end of said housing having a restricted passageway through which said screw will pass, but said head will not pass.

* * * * *